United States Patent [19]

Dufrasnes

[11] Patent Number: 4,647,731

[45] Date of Patent: Mar. 3, 1987

[54] TRANSFORMER CRANKSHAFT LOAD SELECTOR

[75] Inventor: Jean-Claude Dufrasnes, Couillet, Belgium

[73] Assignee: Ateliers de Constructions Electriques de Charleroi (ACEC) Societe Anonyme, Brussels, Belgium

[21] Appl. No.: 751,699

[22] Filed: Jul. 3, 1985

[30] Foreign Application Priority Data

Jul. 4, 1984 [EP] European Pat. Off. ..... 84870091.0

[51] Int. Cl.[4] ..... H01H 19/54

[52] U.S. Cl. ..... 200/11 TC

[58] Field of Search ..... 200/11 TC, 17 R, 18, 200/285; 323/340, 341

[56] References Cited

U.S. PATENT DOCUMENTS 2,723,318 11/1955 Jansen ..... 200/11 TC
3,590,175 6/1971 Bliebtreu et al. ..... 200/11 TC
3,798,395 3/1974 Norman et al. ..... 200/11 TC X
3,902,030 8/1975 Popa ..... 200/11 TC

FOREIGN PATENT DOCUMENTS 2035694A 6/1980 United Kingdom ..... 200/11 TC

*Primary Examiner*—J. R. Scott
*Attorney, Agent, or Firm*—Schwartz, Jeffery, Schwaab, Mack, Blumenthal & Evans

[57] ABSTRACT

A load selector has an insulating cylinder, provided with fixed selector contacts inverting contacts and common point rings, in the interior of which is displaced a drive crankshaft on which are supported commutator modules. The drive crankshaft includes a male coupling element, a female coupling element associated with an upper crank, an off-center tube and a lower crank. A rolling mechanism serves as a lower bearing, and a rolling mechanism serves as the upper bearing. A drain tube is coupled to a central siphon tube which leads to an outlet formed in the lower crank.

22 Claims, 1 Drawing Figure

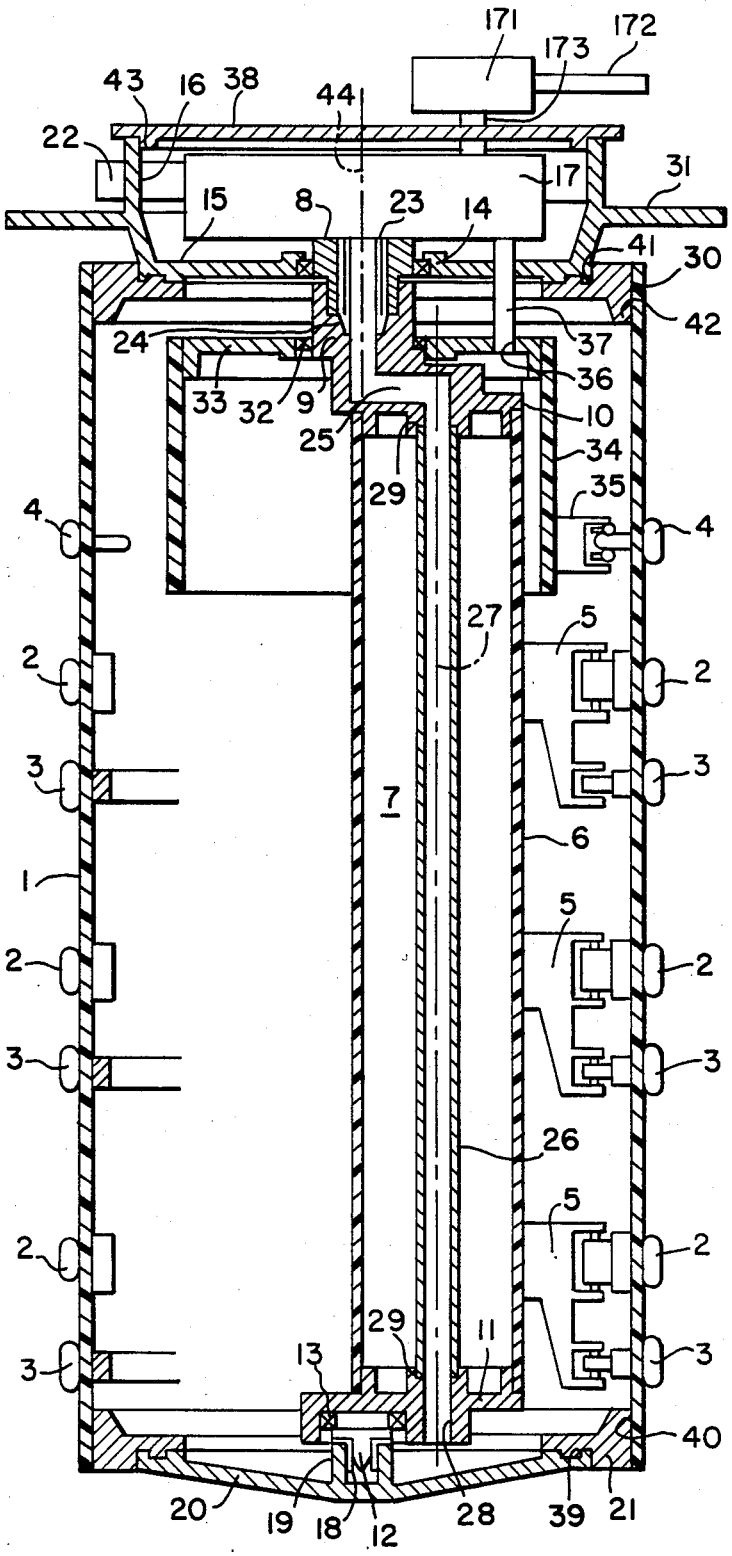
171
172
173
43
16
38
44
22
17
31
15
8
23
14
41
30
42
24
37
36
33
32
9
10
25
34
29
35
4
4
27
5
2
2
3
3
7
6
1
5
2
2
3
3
26
5
2
2
29
11
3
13
3
40
20
19
18
12
28
39
21

TRANSFORMER CRANKSHAFT LOAD SELECTOR

BACKGROUND OF THE INVENTION

1. Field of the Invention

The present invention relates to a load selector for step transformers.

2. Related Art

In this type of apparatus, the different loads comprising the fixed contacts are electrically connected to the outputs of the steps of the transformer. These different loads are arranged, at a sufficient dielectric distance from one another, on the internal wall of an insulating cylinder, acting as an oil receptacle, on the interior of which are arranged movable contacts. In accordance with the voltage of the steps, there corresponds a dielectric distance between adjacent fixed contacts. As a result, for one type of apparatus, the number of fixed contacts arranged on the insulating cylinder is proportional to the diameter of the cylinder. In these apparatuses, increasing the number of fixed contacts necessarily leads to an increase in the diameter of the insulating tube. Generally, these diameter variations entail important modifications of the elements comprising the apparatus and increasing the number of different pieces which must be maintained in stock.

OBJECTS AND SUMMARY OF THE INVENTION

An object of the present invention is to use a maximum number of identical elements to cover different classes of apparatus and thus reduce the costs of fabrication and maintenance of stock. This goal is attained by judiciously modifying the geometry of a limited number of elements.

The invention essentially comprises utilizing, at the level of the selector, on one hand, a crankshaft permitting keeping the same commutator modules, and on the other hand adaptor rings for connecting the oil sump and housing of the drive mechanism to an insulating cylinder of greater diameter.

A load selector has an insulating cylinder, provided with fixed seletor contacts and common point rings, in the interior of which is displaced a drive crankshaft on which are supported commutator modules. The drive crankshaft includes a male coupling element, a female coupling element associated with an upper crank, an off-center tube and a lower crank. A rolling mechanism serves as a lower bearing, and a rolling mechanism serves as the upper bearing.

BRIEF DESCRIPTION OF THE DRAWING

The above and other objects of the invention will be greater appreciated from the following description and accompanying drawing wherein:

The FIGURE is a sectional view of the assembly of a load selector.

DETAILED DESCRIPTION OF THE INVENTION

In the FIGURE, the load selector comprises an insulating cylinder 1 having on the periphery of its interior wall a plurality of fixed selector contacts 2 and common point rings 3 which connect with the steps of the three phases of the transformer. The fixed contacts of an inverter 4 are shown in the upper part of the insulating cylinder 1.

The fixed contacts of the selector 2 and the common point rings 3 cooperate for each phase with a respective selector commutator module 5.

The commutator selector modules 5 are supported on an insulating tube 6 comprising the offset part of a crankshaft 7.

This drive crankshaft 7 comprises a male coupling element 8, a female coupling element 9 associated with an upper crank 10, an insulating tube 6, hereinafter termed the off-center insulating tube, and a lower crank 11 joined at a conical extremity 12 through a lower bearing 13.

The drive crankshaft 17 is centered and driven at its upper part by the male coupling element 8 turning in an upper bearing 14, and supported by a side plate 15 of a drive housing 16 enclosing a drive mechanism 17 (driven by gearing mechanism 171 and a pair of shafts 172 and 173) which actuates the male coupling element 8. The cross-section of the male coupling element 8 is of a non-circular form and is engaged in a recess of the same configuration in the female coupling element 9. The conical extremity 12 is centered by the interposition of a socket 18 on a solid bearing support 19 of the sump 20 which serves to receive oil. This sump 20, designed for an insulating tube of smaller diameter, is joined with the insulating cylinder 1 by a lower connecting ring 21.

A siphon conduit may be provided traversing the crankshaft 7 and permitting the aspiration of oil from the receptacle. This conduit is accessible from the exterior by a connection tube 22 which extends across the drive mechanism 17 and terminating in a drain tube 23 arranged vertically in an axial bore, of greater diameter, in the male coupling element 8 and maintained centered by a fluid-tight seal 24 placed in the female coupling element 9. With the exception of the friction exerted by the seal 24, the drain tube 23 is supported with no mechanical effort. The drain tube 23 leads to a crank or angled conduit 25, internal to the female coupling element 9 and in the upper crank 10. The crank conduit 25 may thus be connected to a siphon tube 26 maintained on an axis 27 of the off-center insulating tube 6 by the upper crank 10 and the lower crank 11. The lower extremity of the siphon tube 26 empties into a hole formed in the lower crank 11 along the axis 27 to be used as an adjustment 28.

A pair of joint seals 29 are provided on the two extremities of the siphon tube 26.

The housing 16, designed for an insulating tube of smaller diameter, is joined to the insulating cylinder 1 by an upper connecting ring 30. The housing 16 has around its periphery a shoulder 31 which connects to the tranformer tank.

The female coupling 9 supports at its base a bearing 32 which is fitted on a plate 33 fixedly connected to an inverted insulating tube 34 on which are mounted the movable inverter contacts 35. The plate 33 is provided with an opening 36 in which is engaged a driving lug 37 actuated by the drive mechanism 17. The drive mechanism 17 actuates, in an independent manner, the inverter by the intermediary of the driving lug 37 and the selector by the intermediary of the male coupling 8.

The insulating cylinder 1, together with the cup 20, the lower connecting ring 21, the housing 16 provided with a cover 38 and the upper connecting ring 30, serves as the oil receptacle for the assembly of the apparatus.

The fluid-tightness of this oil receptacle is assured by a plurality of joints 39, 40, 41, 42, 43 arranged in the grooves made respectively in the lower connecting ring 21, the upper connecting ring 30 and the cover 38.

The insulating tube 1, carrying the fixed inverter contacts 4, the fixed selector contacts 2 and the common point ring 3, are concentric around the same axis 44, termed the axis of the apparatus 44.

The off-center insulating tube 6, carrying the selector control modules 5 has an axis of symmetry of revolution, termed the axis of the crank part 27. This off-center insulating tube constitutes the angled part of the crankshaft 7 which rests on the lower bearing 13 and on the upper bearing and is concentric with the axis of the apparatus 44.

The upper part of the off-center insulating tube 6 is displaced to the interior of the inverter insulating tube 34. According to the class of apparatus, the overlapping part of the off-center insulating tube 6 and of the inverted insulating tube 34 is more or less important accordng to the distance to be arranged between the fixed contacts of the inverter and the plate 33.

The commutator modules of the selector 5 are normally mounted on the off-center insulating tube 6 according to the generatrix contained in the plane formed by the axis of the apparatus 44 and the axis of the crank part 27 at right angles with the fixed selector contacts 2. Nevertheless, to adapt the same commutator modules of the selector 5 to a greater range of diameters of the insulating tube 1, these modules may be mounted in a position deviating more or less from the previously defined normal position. The same result would therefore be obtained by the circular form of the cross-section of the off-center insulating cylinder 6 by an elliptical form and while arranging the adjustable steps in rotation on the lower crank 11 and the upper crank 10. The lower connecting ring 21 and the upper connecting ring 30 are preferably identical and of an appropriate form for being easily placed on the desired exterior diameter.

In this illustrated example the resistances of the passage, not shown, are arranged around the off-center insulating tube 6 in a molded passageway, extending in the free space situated on the lower part of each commutator module of selector 5, and shaped to support the movable contact being displaced opposite each common point ring 3.

When the commutator modules of the selector 5 are at the potential of a neutral point, the off-center insulating tube 6 may be replaced over a part of its length by a metallic tube.

While one embodiment of the invention has been described, it will be understood that is capable of further modificaton, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A transformer outlet load selector comprising:

an insulating cylinder serving as an oil receptacle;

a plurality of fixed selector contacts and neutral point rings provided on an internal wall of said cylinder;

a plurality of fixed inverter contacts provided on an upper part of the internal wall of said insulating cylinder;

a plurality of movable selector commutator modules cooperating with said plurality of fixed selector contacts and neutral point rings;

a drive crankshaft supporting said modules, said drive crankshaft being supported by an upper bearing, disposed in an inverted housing of a drive mechanism, and by a lower bearing, disposed in a bearing support of a sump through an intermediary conical extremity and a socket;

a male coupling element and a female coupling element around which is mounted for rotation a plate provided with an opening;

a driving lug operatively connected to said drive mechanism provided in said opening;

an insulating tube extending downwardly from said plate;

a plurality of movable inverter contacts mounted on said insulating tube and disposed opposite said plurality of fixed inverter contacts;

wherein said drive crankshaft is angled and comprises an off-center part means for supporting said selector commutator modules.

2. An outlet load selector according to claim 1 wherein said off-center part of said drive shaft is provided with a siphon tube means projecting above and below said off-center part for siphoning liquid.

3. An outlet load selector according to claim 2, wherein one of said connecting pieces is a lower crank, and is provided with an outlet tube extending the siphon tube into its lower part.

4. An outlet load selector according to claim 2, wherein one of said connecting pieces is an upper crank, and is provided with an interior crank conduit means for connecting an upper part of the siphon tube to a lower part of a drain tube.

5. An outlet load selector according to claim 1 wherein said off-center part comprises a cylinder having extremities each of which are fixedly secured to one of a plurality of connecting pieces supported on said upper and lower bearings.

6. An outlet load selector according to claim 5: wherein said off-center part of said drive shaft is comprised of an insulating material along at least a part of its height.

7. An outlet load selector according to claim 1 wherein the sump is connected to the insulating cylinder by a lower connecting ring having fluid tight joints.

8. An outlet load selector according to claim 1 wherein the housing of the drive mechanism is connected to the insulating cylinder by an upper connecting ring having fluid tight joints.

9. An outlet load selector according to claim 1 wherein the male coupling element is traversed by a drain tube, and wherein the female coupling element is provided with a fluid tight joint serving to center the drain tube traversing the male coupling element.

10. A transformer outlet load selector comprising:

(a) an insulating cylinder having a top and a bottom and forming a oil reservoir therein, (b) a plurality of fixed selector contacts and neutral point rings on said cylinder, (c) a plurality of fixed inverter contacts on said cylinder, (d) a plurality of movable selector commutator modules in cooperation with said fixed selector contacts, (e) a drive crankshaft supported in bearings at the top and bottom of said cylinder, (f) means for driving said crankshaft, (g) a plurality of movable inverting commutator modules cooperating with and opposite to said fixed inverter contacts, and (h) said drive crankshaft being angled and supporting an off-center insulating tube, said off-center insulating tube supporting said selector commutator modules.

11. A selector as defined in claim 10 wherein said off-center tube includes a siphon tube means extending above, below and through said off-center tube for siphoning liquid.

12. A selector as defined in claim 11 wherein said lower crank includes an outlet tube connecting said siphon tube with the bottom of said cylinder.

13. A selector as defined in claim 11 wherein said upper crank includes an interior crank conduit connected to said siphon tube.

14. A selector as defined in claim 10 wherein said off-center tube includes (1) a male coupling elment and a female encoupling element forming an upper crank at an upper end thereof and (2) a lower crank comprised of a connecting piece disposed at a lower end thereof.

15. A selector as defined in claim 14 wherein said off-center tube is comprised of an insulating material along at least a part of its length.

16. A selector as defined in claim 14 wherein said male and female couplings include a drain tube therethrough, and said female coupling further includes a fluid-tight joint means for centering said drain tube.

17. A selector as defined in claim 14 including an inverted insulating tube housing operatively coupled to said upper crank and having a plurality of movable inverter contacts disposed thereon.

18. A selector as defined in claim 17 including a driving lug extending between said driving means and through said connecting ring and connected to said inverted tube housing.

19. A selector as defined in claim 10 wherein said reservoir disposed at the bottom of said insulating cylinder includes a sump at the bottom thereof and includes a plurality of fluid-tight joints.

20. A selector as defined in claim 10 including a drive housing at the top of said cylinder, said driving means being positioned in said drive housing, an upper connecting ring separating said drive housing and said cylinder and including fluid-tight joints between said drive housing and said cylinder.

21. A selector as defined in claim 10, wherein an axis of rotation of said off-center insulating tube is displaced from a central axis of said off-center insulating tube.

22. A selector as defined in claim 21, further comprising a siphon tube means extending above, below, and through said off-center insulating tube for siphoning liquid;

wherein said siphon tube means is displaced from an axis of rotation of said off-center insulating tube.

* * * * *